US008142132B2

(12) United States Patent
Lech et al.

(10) Patent No.: US 8,142,132 B2
(45) Date of Patent: Mar. 27, 2012

(54) AUTOMATIC OVER-CENTER SYSTEM

(75) Inventors: Richard J. Lech, Burlington, IA (US); Vlad P. Patrangenaru, Schaumburg, IL (US)

(73) Assignee: CNH America LLC, New Holland, PA (US)

( * ) Notice: Subject to any disclaimer, the term of this patent is extended or adjusted under 35 U.S.C. 154(b) by 490 days.

(21) Appl. No.: 12/348,484

(22) Filed: Jan. 5, 2009

(65) Prior Publication Data

US 2010/0172730 A1 Jul. 8, 2010

(51) Int. Cl.
*E02F 3/26* (2006.01)

(52) U.S. Cl. ..... 414/699; 414/694; 414/815

(58) Field of Classification Search ..... 414/680, 414/685, 694, 698, 699, 815; 91/436, 437
See application file for complete search history.

(56) References Cited

U.S. PATENT DOCUMENTS

| | | | | |
|---|---|---|---|---|
| 3,376,984 | A | 4/1968 | Long et al. | |
| 3,904,051 | A | 9/1975 | Tsuchiya et al. | |
| 3,987,914 | A | 10/1976 | VanDerZyl et al. | |
| 4,201,509 | A | 5/1980 | Hansen | |
| 4,720,234 | A | 1/1988 | Stralow | |
| 4,767,255 | A | 8/1988 | Mickelson et al. | |
| 5,584,643 | A | 12/1996 | Nishimura et al. | |
| 5,748,097 | A | 5/1998 | Collins | |
| 6,267,548 | B1 * | 7/2001 | Lech et al. | 414/699 |

FOREIGN PATENT DOCUMENTS

| | | | |
|---|---|---|---|
| JP | 357127024 | A | 8/1982 |
| JP | 358011237 | A | 1/1983 |
| JP | 401239230 | A | 9/1989 |

* cited by examiner

*Primary Examiner* — Donald Underwood
(74) *Attorney, Agent, or Firm* — Patrick M. Sheldrake

(57) ABSTRACT

The present invention is directed to a control circuit for automatically bringing a hydraulically operated work arm into a particular position without having to manually reverse the direction of the hydraulic operating system.

19 Claims, 5 Drawing Sheets

AUTOMATIC OVER-CENTER SYSTEM

FIELD OF THE INVENTION

The present invention relates to a control circuit for assisting operator effected storage of a hydraulically operated articulated work arm into an "over-center" storage position. By permitting simplified operation of the work arm into the storage position, the functionality of the apparatus is increased.

BACKGROUND OF THE INVENTION

Mobile construction equipment such as tractors outfitted with a hydraulically operated articulated work arm carrying any one of a variety of attachments are used for a wide variety of applications. In particular, they are critical machines in the construction of buildings, transportation channels, and almost any other man-made structure. A practical matter involves the transport of such equipment—such as, for example, a backhoe—between the physical locations where it will be used. If the equipment is driven to the desired location over roadways, difficulties associated with the weight distribution of the equipment often arise. In particular, the overhanging, leveraged weight of the backhoe linkage assembly increases the difficulty of controlling the equipment during transportation. The distribution of weight of the backhoe linkage assembly can affect equipment weight balance sufficiently that the weight remaining on the front wheels is lessened and steering control and ride comfort may be compromised.

A common approach to dealing with the undesirable weight distribution of this type of construction equipment is to add weight to the front of the machine to counter the weight of the backhoe linkage assembly. However, this solution is undesirable for several reasons. The additional weight causes the equipment to become more difficult to maneuver, especially in soft ground, more difficult to steer, and more clumsy to operate. In addition, fuel consumption is increased and the equipment cost effectiveness is decreased.

A more desirable solution to the problem of weight distribution has been to move the backhoe linkage assembly into a stored position where its weight is closer to the center of the equipment. For example, Case Corporation of Racine, Wis. builds backhoe-type machines with a distinctive feature, known as an "over-center" system, that permits the weight of the backhoe to be moved closer to the center of gravity of the equipment, whereby the weight moment arm is reduced. By shifting the weight of the backhoe toward the equipment's center of gravity, the need for a front-end counter-weight is eliminated. The "over-center" position of the backhoe linkage assembly is frequently known as the "carry," the "latched," or the "transport" position. The "over-center" system, as noted above, increases the maneuverability of the equipment, particularly in soft ground, and increases the stability of the equipment during road transportation.

While the "over-center" system provides significant benefits, use of the system requires operator skills that are acquired only through experience. Thus, while not always difficult for regular operators of the equipment, the technique may often be awkward for new or occasional operators of the machine. The technique involves a combination of operator actions that must be completed in timed sequence. The technique of moving the backhoe linkage assembly into the "over-center" position requires the operator to activate the lift cylinder and raise the work arm toward its uppermost position. At the moment that the lift cylinder is at its minimum length, the operator must then rapidly change the direction of the hydraulic control spool to reverse the direction of the lift cylinder operation, thereby driving the backhoe linkage assembly into the "over-center" transport position. If the directional change of its control spool is not effected at the correct moment, the backhoe assembly will fail to reach the transport position. The entire process must then be repeated. First-time operators and operators without significant experience often have difficulty performing the technique.

One solution is described in U.S. Pat. No. 6,267,548 which is directed to a control circuit for use in combination with an apparatus having a hydraulically operated articulated work arm, such as a backhoe machine, for which there are desired arm positions, such as an "over-center" transport position. The control circuit that is used in combination with the apparatus has a valve, preferably a solenoid valve; a source of electricity for operating the solenoid valve; and a switching mechanism. The solenoid valve is operably connected with the work arm hydraulic operating system. The control circuit provides an apparatus for reducing the importance of operator performance in placing equipment work arms into the over-center storage/transport position. Thus, new and less experienced operators can prepare the backhoe for travel between work sites.

While the prior art allows for a type of over-center boom assist, it would be beneficial to provide a further simplified boom-stowing process by making it possible to stow the boom more reliably at multiple boom speeds and with a less violent latching action.

SUMMARY OF THE INVENTION

The invention is directed to a control circuit for used in combination with an apparatus having an articulated work arm that is movable to a transport position.

The present invention can be applied to any hydraulically operated articulated work arm in which it is necessary to reverse the flow of fluid through the hydraulic cylinder in order to achieve a desired position of the work arm. The control circuit that is used in combination with the apparatus comprises a valve, preferably an electrically activated switch or solenoid valve; a source of electricity for operating the electrically activated switch or solenoid valve; and a switching mechanism.

The switching device is operably connected with the work arm hydraulic operating system. A switching mechanism is electrically connected in series between the electrical source and the electrically activated switch to control the operation of the electrically activated switch. The switching mechanism includes a manually-actuated operator switch and a position-actuated switch located remotely from the operator switch in an operative position associated with the work arm and responsive to the position of the work arm so as to connect the electrical source to the electrically activated switch when the operator switch is closed and the work arm is at a preselected position in order to reverse fluid flow from the hydraulic operating system applied to the work arm.

The switching device is positioned between the operator control and main valves of the hydraulic operating system, whereby the switching device is moved from a first position to a second position to reverse the signal sent by the operator control to the main valve when the operator switch is closed and the work arm is at the preselected position connecting the electrical source to the solenoid.

The invention is also directed to an apparatus having an articulated work arm that is movable to a transport position and a hydraulic operating system therefore. The apparatus has a switching device which is operably connected with the work arm hydraulic operating system. A control circuit having a electrically activated switch is electrically connected with the switching device. An electrical source and a switching mechanism are electrically connected in series to control the operation of the electrically activated switch. The switching mechanism includes a manually-actuated operator switch and a position-actuated switch located remotely from the operator switch in an operative position associated with the work arm and responsive to the position of the work arm, so as to connect the electrical source to the electrically activated switch when the operator switch is closed and the work arm is at a preselected position. Thereby, the switching device is moved from a first position to a second position to reverse the signal sent by the operator hydraulic valves when the operator switch is closed and the work arm is at the preselected position connecting the electrical source to the solenoid.

The invention is also directed to a method of storing a work arm activated by a hydraulic cylinder in an over-center position with respect to a base of the apparatus. The hydraulic cylinder is retracted to bring the work arm toward the base of the work vehicle in response to an operator-generated signal. A manually-actuated operator switch is activated. A position-actuated switch is next activated when the work arm has reached the over-center position. This energizes a switching device which reverses the operator-generated signal, causing the hydraulic cylinder to be extended to bring the work arm toward the base of the work vehicle when the boom has reached the over-center position in response to the same operator-generated signal which retracted the hydraulic cylinder The invention has many advantages over the systems currently used. As the signal is automatically switched based on the position of the operator switch and position-actuated switch, the transition of the work arm as the work arm goes "over-center" is controlled and can be done at relatively low engine speeds (rpms). The work arm is stowed more reliably at multiple boom speeds without the violent latching action required by previous devices. This allows for less wear on the work arm and components associated therewith. It also allows for less experienced operators to operate the backhoe/loader machine. Whether the machine is a pilot-operated or manually-operated machine, the control circuit that provides the automatic switching greatly reduces the skill and expertise required by the operator.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

The accompanying drawings, which are incorporated in and constitute a part of this specification, illustrate the preferred embodiment of the invention, and together with the description, serve to explain the principles of the invention.

DETAILED DESCRIPTION OF THE INVENTION

Figure 1:
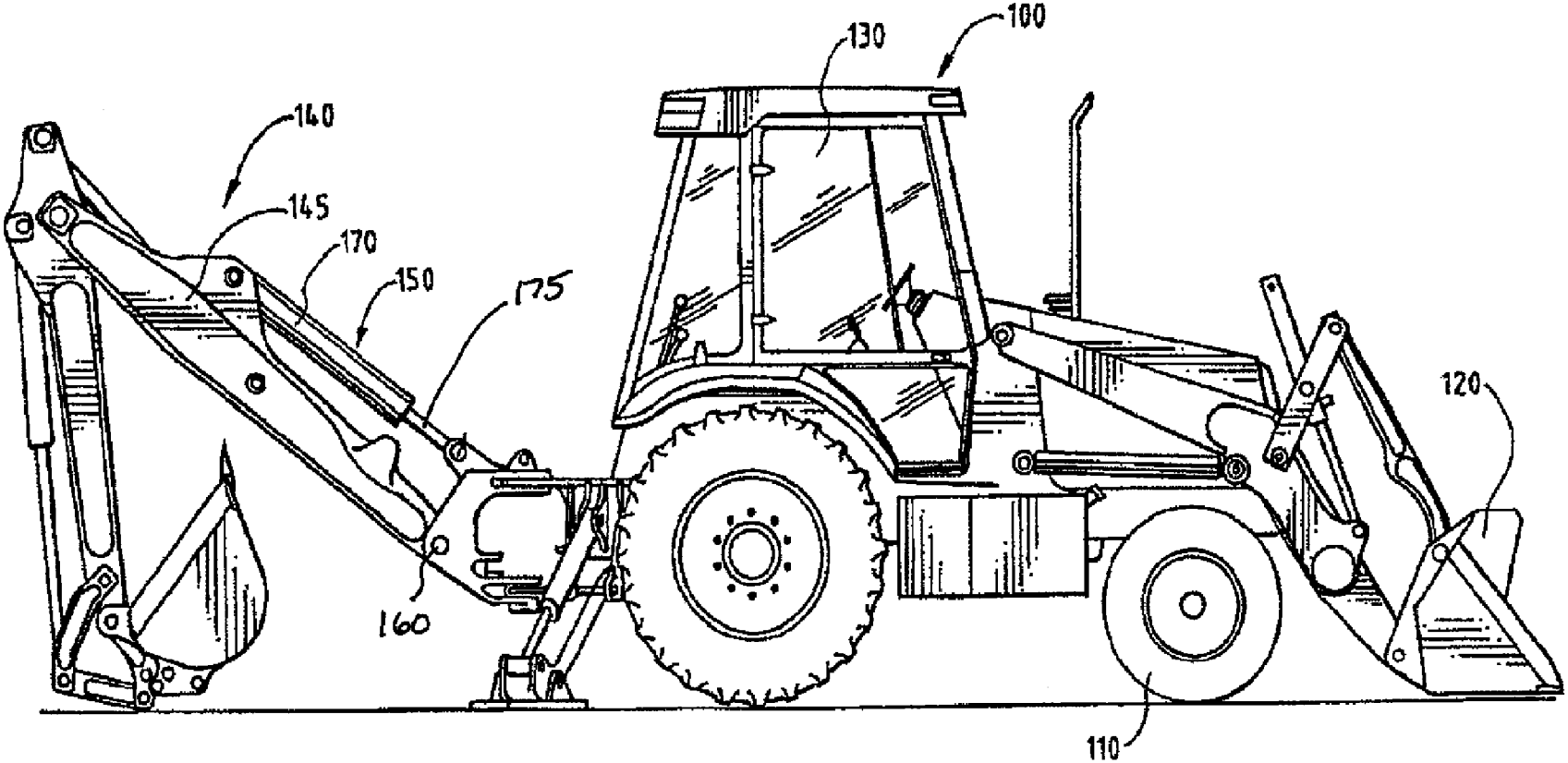
FIG. 1 is a side elevation of a backhoe machine that is in an operating position.

Reference will now be made in detail to the present preferred embodiment of the control circuit of the invention, examples of which are illustrated in the accompanying drawings. Wherever possible, the same reference characters will be used throughout the drawings to refer to the same or like parts.

The present invention is directed to a combination of an apparatus having a hydraulically-operated work arm and a control circuit. The work arm of the apparatus has a range of motion configured to be positioned at various desired locations. In one embodiment of the invention, the apparatus is a backhoe-type machine in which the work arm may be placed into an "over-center" position for transportation of the machine.

The present invention is applicable to any apparatus having a hydraulically-operated work arm. FIG. 1 is a side elevation of one type of apparatus having a hydraulically-operated work arm, namely a backhoe/loader machine 100. Backhoe/loader machine 100 includes an operator's compartment 130, a first implement, such as a loader 120, and a second implement, such as a backhoe 140. In a typical backhoe/loader machine 100, the weight is unevenly distributed. The backhoe 140 portion of the backhoe/loader machine 100 is disproportionately heavy and causes shifts in the center of gravity rearwardly away from the operator's compartment 130 when extended behind the operator's compartment. The off-center weight distribution of the backhoe/loader machine 100 makes ground transportation of the backhoe/loader machine 100 more difficult. For example, steering control is diminished and the ride is uncomfortable at typical road speeds.

Figure 3:
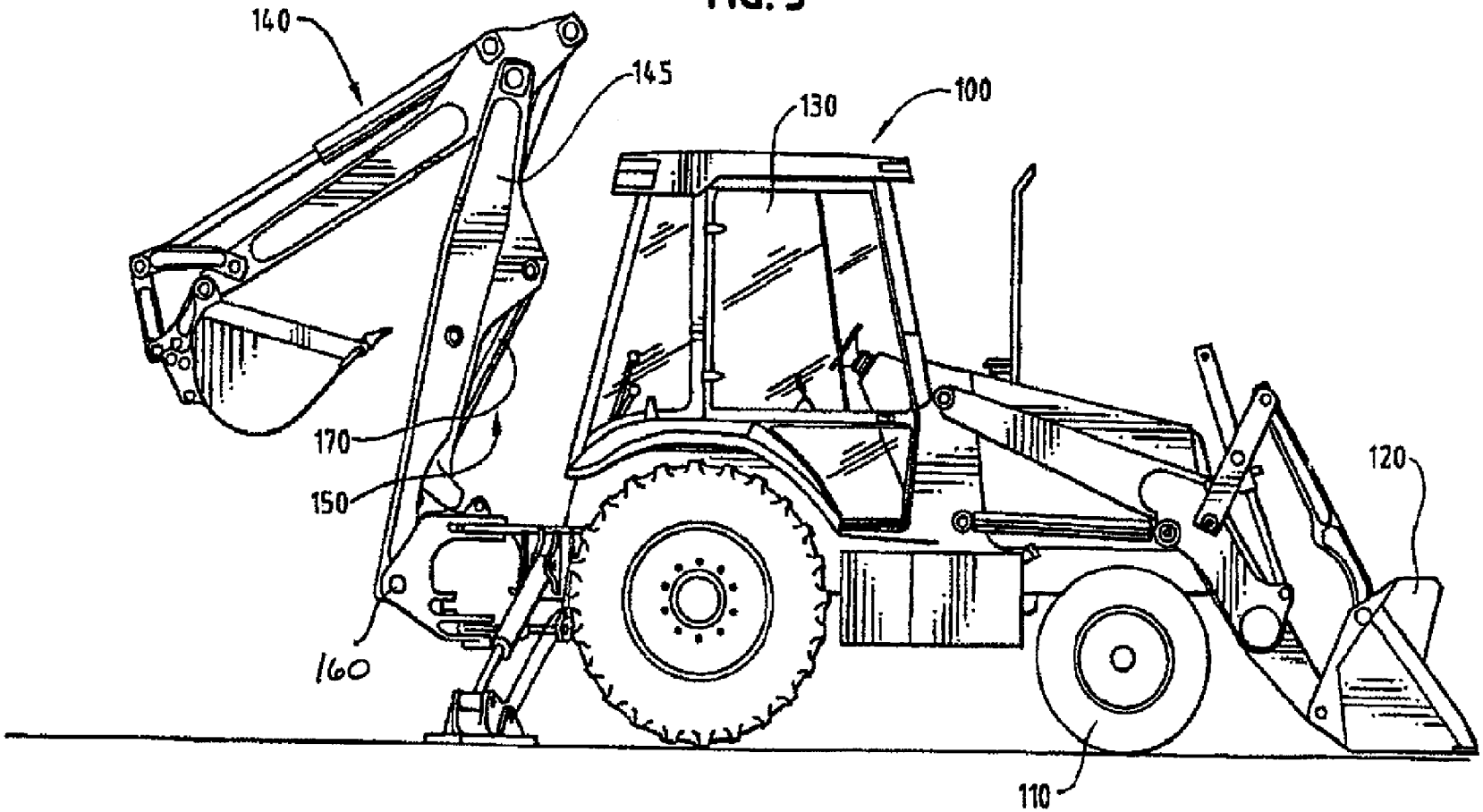
FIG. 3 is a side elevation of the backhoe machine that is in an "over-center" or transport position.

For transportation purposes, the weight distribution of the backhoe/loader machine 100 is improved by moving the backhoe 140 weight toward the center of the backhoe/loader machine 100. By moving the backhoe 140 toward the operator's compartment 130, the center of gravity for the backhoe/loader machine 100 is shifted forward and it is not necessary to add weight to the front wheels 110 to counter balance the weight of the backhoe attachment. As a result, the backhoe/loader machine 100 becomes more maneuverable, more stable on the road, and better able to negotiate difficult terrain. The different locations of the backhoe 140 in relation to the operator's compartment 130 between the operating and transport positions are depicted in FIGS. 1 and 3, respectively.

Figure 2:
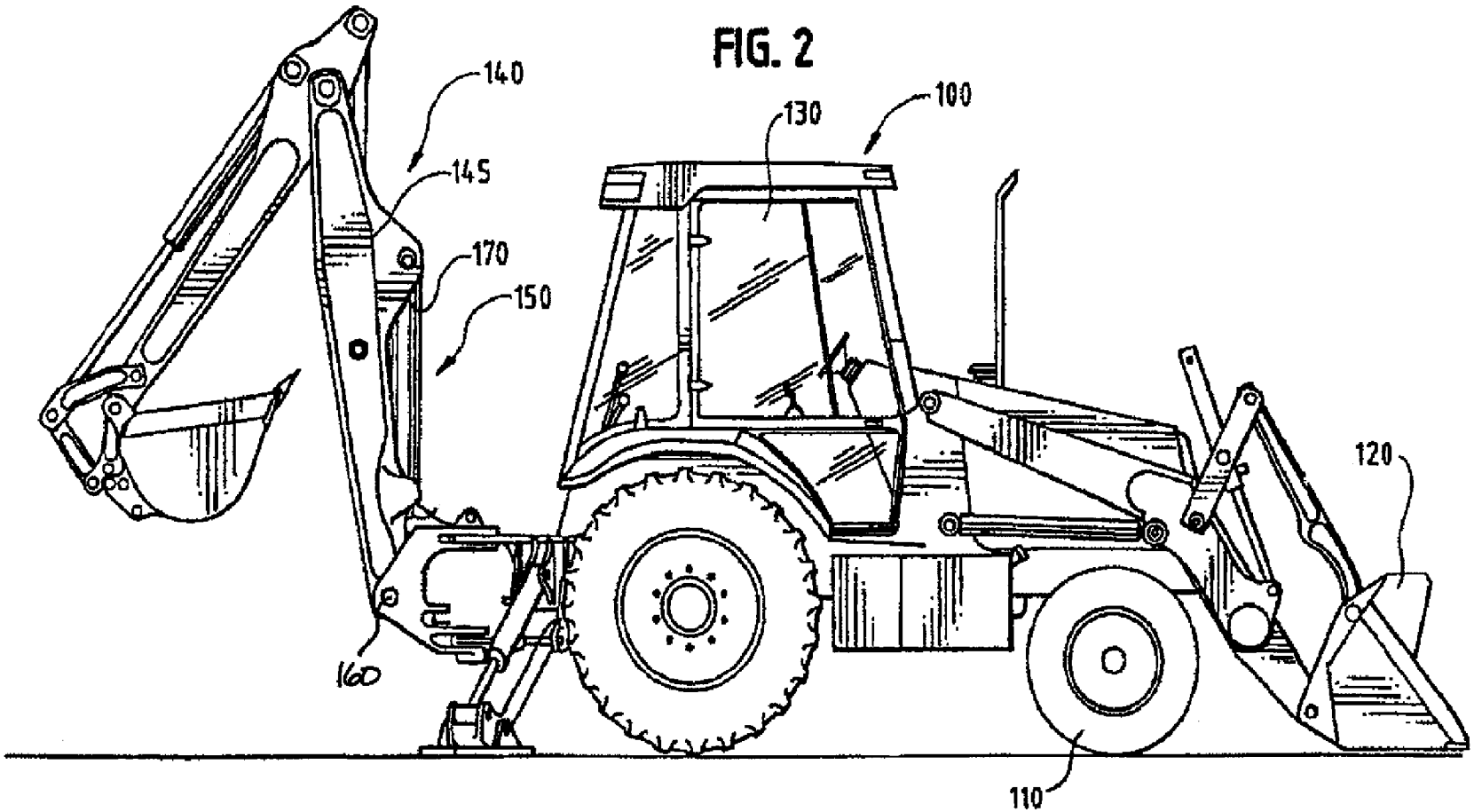
FIG. 2 is a side elevation of the backhoe machine that is in transition between and operating position and a transport or carry position.

The transport position of the backhoe 140 (FIG. 3) can be described as an "over-center" position because the lift cylinder 150 is moved beyond its shortest length and the backhoe 140 is brought toward the operator's compartment 130. A hydraulically-operated lift cylinder 150 is typically used to lift work arm 145 of the backhoe 140 upwardly from its operating position by rotating the work arm about a pivot point 160. As the work arm 145 is lifted toward its vertical position, the lift cylinder 150 shortens. The direction of flow of hydraulic fluid is such that the piston of the lift cylinder 150 moves into the cylinder portion, toward the head side 170 of the cylinder. As the work arm 145 of the backhoe 140 moves toward a vertical position, as depicted in FIG. 2, the lift cylinder 150 approaches its shortest length. In order to bring the work arm 145 into an "over-center" position, the flow of hydraulic fluid within the lift cylinder 150 must be reversed so that the length of the lift cylinder 150 can increase as the work arm 145 is pulled past the vertical position and toward the operator's compartment 130.

Presently, in order to bring the work arm 145 into the over-center position, the operator of the backhoe/loader machine 100 must operate the lift cylinder 150 in such a way that the flow direction of hydraulic fluid is manually reversed at precisely the right time. Correctly executing the flow direction reversal operating sequence can be difficult for new or infrequent operators of the backhoe/loader machine 100. First the operator must initiate the lift cylinder's 150 lifting of the work arm 145 upward toward a vertical position. As the work arm 145 approaches a vertical position and when the lift cylinder 150 is positioned at its shortest length, the operator must quickly reverse the direction of hydraulic fluid flow in the lift cylinder 150 in order to force the lift cylinder 150 to begin to lengthen again and to move the work arm 145 into the over-center position. If the operator's timing is off, i.e., the lift cylinder 150 is lengthened sufficiently prior to the work arm 145 attaining the vertical position, the lift cylinder 150 will prevent the work arm 145 from reaching the "over-center" position. The operator must then lower the work arm 145 and repeat the procedure.

In order to overcome the deficiencies of the existing method, the present invention applies a control circuit to automatically sense when the work arm 145 is in its vertical position, or in any other suitable preselected position, to automatically reverse the direction of hydraulic fluid flow to the lift cylinder 150. Schematic representations of exemplary embodiments of the control circuit of the invention are shown in FIGS. 4, 5 and 6.

Figure 4:
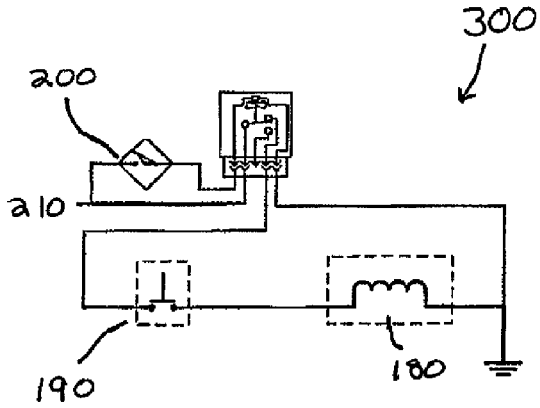
FIG. 4 is a schematic drawing of a portion of a control circuit of the invention that can be used in combination with a machine having an articulate work arm.
Figure 5:
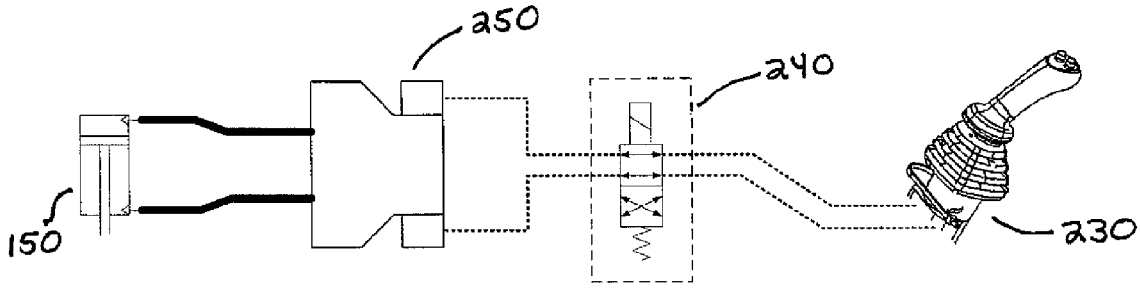
FIG. 5 is a schematic drawing showing the electronic switching device in a pilot-controlled system.
Figure 6:
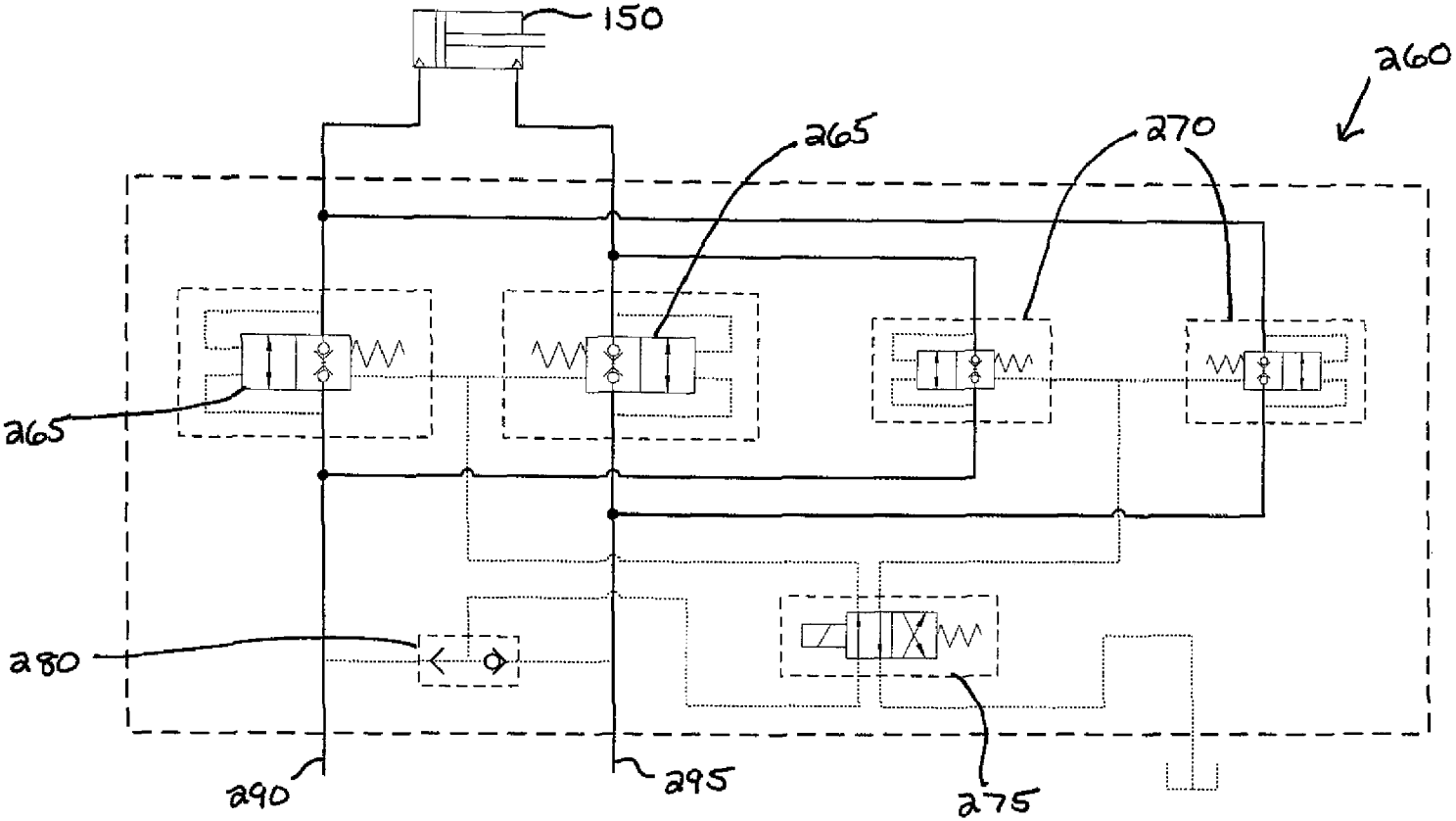
FIG. 6 is a schematic drawing showing the cylinder-mounted manifold of a manually-controlled system.

Referring to FIG. 4, a control circuit 300 includes an electrically activated switch, such as a solenoid for a valve having a coil 180 that is connected to an electrical source 210 for operating the valve that is operably connected with the hydraulic operating system of the work arm 145 (see FIG. 1) by means of an electronic switching device 240 (FIG. 5) or an electronic switching device 275 of a valve manifold 260 (FIG. 6). The control circuit 300 further includes a switching mechanism that is electrically connected in series between the electrical source 210 and the solenoid valve coil 180 in order to control the operation of the solenoid valve coil 180. The switching mechanism includes a first, manually-actuated operator switch 190 and a second, position-actuated switch 200. The second, position-actuated switch 200 is connected serially with the first, manually-actuated operator switch 190. The position-actuated switch 200 is physically located away from the manually actuated operator switch 190 and is in an operative position associated with the work arm 145 and responsive to the position of the work arm 145. The position-actuated switch 200 permits connection of the electrical source 210 to the solenoid valve coil 180 when the operator switch 190 is closed and the work arm 145 is located at a preselected position or orientation, such as vertical. It is to be understood that the term "position" includes any possible orientations of the work arm.

The operator switch 190, which is in series with the solenoid valve coil 180, is located conveniently to the operator, such as being located in the operator's compartment 130. The operator switch 190 can be in the form of an actuator button or a similar device. The position-actuated switch 200 is located so as to be associated with the work arm 145. In the embodiments shown, the position-actuated switch 200 is located at the base of the lift cylinder 150 and is indexed to detect a vertical position of the work arm 145. In order to move the backhoe 140 from an operating position to an "over-center" position, the operator activates the hydraulic operating system such that the lift cylinder 150 begins to shorten and to pivotally move the work arm 145 upward. At substantially the same time that the lift cylinder 150 is activated, or prior to such activation, the operator depresses the actuator button of the operator switch 190. When the work arm 145 reaches a vertical position, the position-actuated switch 200 is depressed by the movement of the work arm 145, completing the control circuit 300. Once the control circuit 300 is complete, the electrical source 210 becomes connected to the solenoid valve coil 180.

Referring to FIGS. 4 and 5, the connection of the electrical source 210 to the solenoid valve coil 180 causes the solenoid valve coil 180 to be energized, which in turn energizes a low-flow electronic switching device 240, causing the electronic switching device 240 to be moved to the position shown in FIG. 5. In this position, the electronic switching device 240 causes the signals from a pilot joystick 230, which the operator uses to control the work arm, to the main valve 250 to be switched or reversed. For example, when the work arm 145 is to be stowed and the signals are reversed, the "work arm raise" signal from the pilot joystick is directed to a "work arm lower" signal to the main valve 250. The "work arm lower" signal causes the main valve 250 to supply the hydraulic fluid to the head side 170 of the lift cylinder 150, pushing the piston away from the head side 170 of the lift cylinder 150, thereby again increasing the length of the lift cylinder 150. Rather than the operator having to manually reverse the direction of the lift cylinder 150 when the work arm 145 is precisely at the vertical position, the operator simply continues to hold the joystick 230 in the retract position while simultaneously actuating the operator switch 190. This "signal switching" process emulates a well-timed command reversal by the operator.

When the operator desires to move the work arm 145 from the stowed or transport position to the work position, the operator moves the joystick 230 in the direction to rotate the work arm 145 away from the operator's compartment. As the electronic switching device 240 remains in the "switched" position shown in FIG. 5, the "work arm lower" signal from the pilot joystick 230 is directed to a "work arm raise" signal to the main valve 250, causing the main valve to supply the hydraulic fluid to the rod side 175 of the lift cylinder 150, pushing the piston toward the head side 170 of the lift cylinder 150, decreasing the length of the lift cylinder 150. At the same time that the lift cylinder 150 is activated, or prior to such activation, the operator depresses the actuator button, or other device, of the operator switch 190. When the work arm 145 reaches the vertical position, the position-actuated switch 200 completes the control circuit 300. Once the control circuit 300 is complete, the electrical source 210 becomes connected to the solenoid valve coil 180. Referring to FIGS. 4 and 5, the connection of the electrical source 210 to the solenoid valve coil 180 causes the solenoid valve coil 180 to be energized, which in turn energizes the low-flow electronic switching device 240, causing the electronic switching device 240 to be moved from the position shown in FIG. 5, allowing the signals from a pilot joystick 230 to the main valve 250 to return to their normal, unreversed orientation. Rather than the operator having to manually reverse the direction of the lift cylinder 150 when the work arm 145 is precisely at the vertical position, the operator simply continues to hold the joystick 230 in the extend position while simultaneously actuating the operator switch 190.

As the signal is automatically switched based on the position of the operator switch 190 and position-actuated switch 200, the transition of the work arm as the work arm is rotated to its "over-center" position is controlled and can be done at relatively low engine speeds (rpms). Use of switches 190, 200 allows the work arm to be stowed more reliably at multiple boom speeds and with a much less violent latching action than required by previous devices.

Referring to FIGS. 4 and 6, a second embodiment of the invention is shown. In this embodiment, the operator controls the work arm 145 through manual pedals, etc. (not shown) rather than with a pilot joystick as described above. In this embodiment, the control circuit 300 interacts with an electronic switching device 275 of a valve manifold 260 which may be mounted on the lift cylinder 150. The valve manifold 260, as shown in FIG. 6, has two pair of pilot-operated poppet valves 265, 270. In the embodiment shown, the first pair of poppet valves 265 is larger than the second pair of poppet valves 270. The larger poppet valves 265 allow a large volume of hydraulic fluid to flow through the poppet valves 265 in a given time frame, thereby allowing for the quicker movement of the work arm. The manifold 260 also has the electronic switching device 275 and a resolver or logic shuttle check 280. The invention is not limited to the types of valves shown, the relative sizes indicated or the number of valves, i.e. more than two pair of valves may be used. Also, many types of valves and many sizes can be used without departing from the scope of the invention.

As previously described with respect to FIG. 4, the connection of the electrical source 210 to the solenoid valve coil 180 through the closed operator switch 190 and the closed position-actuator switch 200 causes the solenoid valve coil 180 to be energized, which in turn energizes a low-flow electronic switching device 275, causing the electronic switching device 275 to be moved to the position shown in FIG. 6. A pilot signal supplies one of the two valve pairs via the switching device 275. The pilot signal is drawn from the higher pressure of the two cylinder main valve work-ports 290, 295 via a resolver 280. With the electronic switching device 275 energized, the resolved pilot signal is directed to the pair of high-flow poppet valves 265, thereby closing the primary flow path between work-ports 290, 295 and lift cylinder 150 and allowing the reversing flow path to open through the pair of low-flow poppet valves 270. This construction allows the manually-operated hydraulics to be reversed. For example, when the work arm 145 is to be stowed and the signals are reversed, the operator operates the hydraulics directed to a "work arm raise" command that the control circuit 300 and valve manifold 260 translate to a "work arm lower" command. This arrangement causes the hydraulic fluid to flow through the reverse pair of low-flow poppet valves 270, causing the hydraulic fluid to be delivered to the head side 170 of the lift cylinder 150 in a controlled manner, pushing the piston away from the head side 170 of the lift cylinder 150, thereby again increasing the length of the lift cylinder 150. Rather than the operator having to manually reverse the direction of the lift cylinder 150 when the work arm 145 is precisely at the vertical position, the operator simply continues to manually retract the work arm while simultaneously actuating the operator switch 190. This "signal switching" process emulates a well-timed command reversal by the operator.

In the embodiment shown, the pair of low-flow poppet valves 270 restricts the flow of the hydraulic fluid relative to the pair of high-flow poppet valves 265. Consequently, the movement of the work arm 145 when the work arm 145 has moved past the "over-center" position toward the operator's compartment 130 is slowed and controlled to minimize the wear to the work arm 145 and related components when the work arm 145 reaches its stowed position.

When the operator desires to move the work arm 145 from the stowed position to the work position, the operator manually operates the controls to rotate the work arm 145 away from the operator's compartment. As the electronic switching device 275 remains in the "switched" position shown in FIG. 6, the "work arm lower" command is translated to a "work arm raise" command. This arrangement causes the hydraulic fluid to again flow through the reverse pair of low-flow poppet valves 270, causing the hydraulic fluid to be delivered to the rod side 175 of the lift cylinder 150, pushing the piston toward the head side 170 of the lift cylinder 150, decreasing the length of the lift cylinder 150. At the same time that the lift cylinder 150 is activated, or prior to such activation, the operator depresses the actuator button, or other device, of the operator switch 190. When the work arm 145 reaches the vertical position, the position-actuated switch 200 completes the control circuit 300. Once the control circuit 300 is complete, the electrical source 210 becomes connected to the solenoid valve coil 180. Referring to FIGS. 4 and 6, the connection of the electrical source 210 to the solenoid valve coil 180 causes the solenoid valve coil 180 to send a signal to the low-flow electronic switching device 275. This signal causes the electronic switching device 275 to be de-energized and moved from the position shown in FIG. 6, directing the resolved signal to the secondary poppet valve pair, thereby closing the secondary reversing flow-path used for the assist mode while the backhoe is "over-center". This allows the hydraulic fluid to flow through the pair of larger high-flow poppet valves 265, allowing the operator to control the work arm 145 in the normal manner. Rather than the operator having to manually reverse the direction of the lift cylinder 150 when the work arm 145 is precisely at the vertical position, the operator simply continues to manually deploy the work arm 145 while simultaneously actuating the operator switch 190.

If the operator switch 190 is not activated, the backhoe 140 must be put into the "over-center" position by the method currently used in which the operator must decide when to reverse the direction of the lift cylinder 150. If the position-actuated switch 200 or the operator switch 190 are activated independently, but both are not activated together, there is no effect on the operation of the backhoe 140.

The invention, as described with reference to the embodiments shown, has many advantages over the systems currently used. As the signal is automatically switched based on the position of the operator switch 190 and position-actuated switch 200, the transition of the work arm as the work arm goes "over-center" is controlled and can be done at relatively low engine speeds (rpms). The work arm is stowed more reliably at multiple boom speeds and with a much less violent latching action than required by previous devices. This arrangement allows for less wear on the work arm 145 and components associated therewith. It also allows for less experienced operators to operate the backhoe/loader machine 100. Whether the machine is a pilot-operated or manually-operated machine, the control circuit that provides the automatic switching greatly reduces the skill and expertise required by the operator.

Although reference has been made to the use of the present invention in conjunction with bringing the backhoe portion of a backhoe/loader machine into an "over-center" position for the purpose of explanation, it is understood that alternative uses for the control circuit of the invention exist. It also will be apparent to those skilled in the art that various modifications and variations can be made in the design and construction of the control circuit without departing from the scope or spirit of the invention.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. In combination with an apparatus having an articulated work arm that is movable to a transport position and a hydraulic operating system therefore, a control circuit comprising:

a switching device operably connected with the work arm hydraulic operating system having a first position configured for directing flow in a first direction and a second position configured for directing flow in a second direction that is reversed from the first direction;

an electrically activated switch electrically connected with the switching device;

an electrical source for operating the electrically activated switch; and a switching mechanism electrically connected in series between the electrical source and the electrically activated switch to control the operation of the electrically activated switch, the switching mechanism including a manually-actuated operator switch and a position-actuated switch located remotely from the operator switch in an operative position associated with the work arm and responsive to the position of the work arm so as to connect the electrical source to the electrically activated switch when the operator switch is closed and the work arm is at a preselected position in order to reverse fluid flow from the hydraulic operating system applied to the work arm.

2. The control circuit of claim 1 wherein the switching device is positioned between an operator control and at least one main valve of the hydraulic operating system, whereby the switching device is moved from the first position to the second position to reverse the signal sent by the operator control to the at least one main valve when the operator switch is closed and the work arm is at the preselected position connecting the electrical source to the electrically activated switch.

3. In combination with an apparatus having an articulated work arm that is movable to a transport position and a hydraulic operating system therefore a control circuit comprising:

a switching device operably connected with the work arm hydraulic operating system having a first position configured for directing flow in a first direction and a second position configured for directing flow in a second direction that is reversed from the first direction;

an electrically activated switch electrically connected with the switching device;

an electrical source for operating the electrically activated switch;

a switching mechanism electrically connected in series between the electrical source and the electrically activated switch to control the operation of the electrically activated switch, the switching mechanism including a manually-actuated operator switch and a position-actuated switch located remotely from the operator switch in an operative position associated with the work arm and responsive to the position of the work arm so as to connect the electrical source to the electrically activated switch when the operator switch is closed and the work arm is at a preselected position in order to reverse fluid flow from the hydraulic operating system applied to the work arm; and wherein the switching device is located in a valve manifold mounted on a lift cylinder of the hydraulic operating system.

4. The control circuit of claim 3 wherein the valve manifold has a resolver operably connected to main valves of the hydraulic operating system, the resolver detecting the flow of hydraulic fluid through the main valves and sending a resolved pilot signal to the switching device based on relative pressures in the main valves.

5. The control circuit of claim 4 wherein the manifold has two pair of hydraulic control valves which are in fluid communication with the main valves of the hydraulic operating system, a primary valve pair in fluid communication with a primary flow path and a secondary valve pair in fluid communication with a secondary reverse flow path whereby, during normal operation, the switching device directs the resolved pilot signal to the secondary valve pair, closing the secondary valve pair and the secondary reverse flow path.

6. The control circuit of claim 4 wherein the manifold includes two pair of hydraulic control valves which are in fluid communication with the main valves of the hydraulic operating system, a first valve pair in fluid communication with a first flow path and a second valve pair in fluid communication with a second reverse flow path whereby, during a stowing operation of the articulated work arm, the switching device directs the resolved pilot signal to the first valve pair, closing the first valve pair and the first flow path and opening the second reverse flow path.

7. The control circuit of claim 5 wherein each of the valves of the first valve pair and the second valve pair are poppet valves.

8. The control circuit of claim 5 wherein the valves of the first valve pair are larger than the valves of the second valve pair, whereby a larger volume of hydraulic fluid flows through the first valves than through the second valves.

9. An apparatus having an articulated work arm that is movable to a transport position and a hydraulic operating system therefore, the apparatus comprising:

an operator control configured to transmit work arm commands to the work arm hydraulic operating system:

a switching device operably connected with the work arm hydraulic operating system;

a control circuit having a electrically activated switch electrically connected with the switching device, an electrical source for operating the electrically activated switch and a switching mechanism electrically connected in series between the electrical source and the electrically activated switch to control the operation of the electrically activated switch;

the switching mechanism including a manually-actuated operator switch and a position-actuated switch located remotely from the operator switch in an operative position associated with the work arm and responsive to the position of the work arm so as to connect the electrical source to the electrically activated switch when the operator switch is closed and the work arm is at a preselected position;

whereby the switching device is moved from a first position to a second position to reverse the signal sent by the operator control to the work arm hydraulic operating system when the operator switch is closed and the work arm is at the preselected position connecting the electrical source to the electrically activated switch.

10. The apparatus of claim 9 wherein the operator switch is located in an operator compartment of the apparatus.

11. The apparatus of claim 9 wherein the position-actuated switch is located at the base of a lift cylinder and is indexed to detect a vertical position of the articulated work arm.

12. The apparatus of claim 9 wherein the switching device is positioned between the operator control and a main valve of the hydraulic operating system.

13. The apparatus of claim 9 wherein the switching device is located in a valve manifold mounted on a lift cylinder of the hydraulic operating system.

14. An apparatus having articulated work arm that is movable to a transport position and a hydraulic operating system therefore, the apparatus comprising:

a switching device operably connected with the work arm hydraulic operating system;

a control circuit having a electrically activated switch electrically connected with the switching device, an electrical source for operating the electrically activated switch and a switching mechanism electrically connected in series between the electrical source and the electrically activated switch to control the operation of the electrically activated switch;

the switching mechanism including a manually-actuated operator switch and a position-actuated switch located remotely from the operator switch in an operative position associated with the work arm and responsive to the position of the work arm so as to connect the electrical source to the electrically activated switch when the operator switch is closed and the work arm is at a preselected position;

whereby the switching device is moved from a first position to a second position to reverse the signal sent by an operator control when the operator switch is closed and the work arm is at the preselected position connecting the electrical source to the electrically activated switch; and wherein the valve manifold has a resolver operably connected to main valves of the hydraulic operating system, the resolver detecting the flow of hydraulic fluid through main valves and sending a resolved pilot signal to the switching device based on relative pressures in the main valves.

15. The apparatus of claim 14 wherein the manifold has two pair of hydraulic control valves which are in fluid communication with the main valves of the hydraulic operating system, a first valve pair in fluid communication with a first flow path and a second valve pair in fluid communication with a second reverse flow path whereby, during normal operation, the switching device directs the resolved pilot signal to the second valve pair, closing the second valve pair and the second reverse flow path.

16. The apparatus of claim 15 wherein the valves of the primary valve pair are larger than the valves of the secondary valve pair, whereby a larger volume of hydraulic fluid flows through the primary valves than through the secondary valves.

17. A method of storing a work arm activated by a hydraulic cylinder in an over-center position with respect to a base of the apparatus, the method comprising the steps of:

activating a manually-actuated operator switch;

retracting the hydraulic cylinder to bring the work arm toward the base of the work vehicle in response to an operator-generated signal;

activating a position-actuated switch when the work arm has reached the over-center position;

energizing a switching device which reverses the operator-generated signal; and extending the hydraulic cylinder to bring the work arm toward the base of the work vehicle when the boom has reached the over-center position in response to the same operator-generated signal which retracted the hydraulic cylinder; and wherein the switching device is located in a valve manifold mounted on the hydraulic cylinder, the valve manifold having a resolver operably connected to main valves which supply the hydraulic cylinder with hydraulic fluid, the resolver detecting the flow of hydraulic fluid through the main valves and sending a resolved pilot signal to the switching device based on relative pressures in the main valves.

18. The method as recited in claim 17 wherein the manifold has two pair of hydraulic control valves which are in line with the main valves, a first valve pair in line with a first flow path and a second valve pair in line with a second reverse flow path whereby, during normal operation, the switching device directs the resolved pilot signal to the second valve pair, closing the second valve pair and the second reverse flow path.

19. The method as recited in claim 17 wherein the manifold has two pair of hydraulic control valves which are in fluid communication with the main valves, a first valve pair in line with a first flow path and a second valve pair in fluid communication with a second reverse flow path whereby, during a stowing operation of the work arm, the switching device directs the resolved pilot signal to the first valve pair, closing the first valve pair and the first flow path and opening the second reverse flow path.

* * * * *